US009835344B2

(12) United States Patent
Vrzalik et al.

(10) Patent No.: US 9,835,344 B2
(45) Date of Patent: Dec. 5, 2017

(54) SYSTEM FOR SUPPORT AND THERMAL CONTROL

(71) Applicant: Huntleigh Technology Limited, Dunstable, Bedforshire (GB)

(72) Inventors: John Vrzalik, San Antonio, TX (US); KZ Hong, San Antonio, TX (US); Mathew Pickering, San Antonio, TX (US)

(73) Assignee: Huntleigh Technology Limited (GB)

( * ) Notice: Subject to any disclaimer, the term of this patent is extended or adjusted under 35 U.S.C. 154(b) by 480 days.

(21) Appl. No.: 13/745,280

(22) Filed: Jan. 18, 2013

(65) Prior Publication Data

US 2013/0189920 A1 Jul. 25, 2013

Related U.S. Application Data

(60) Provisional application No. 61/588,784, filed on Jan. 20, 2012.

(51) Int. Cl.
*F24F 7/007* (2006.01)
*A47C 21/04* (2006.01)

(52) U.S. Cl.
CPC ..... *F24F 7/007* (2013.01); *A47C 21/044* (2013.01)

(58) Field of Classification Search
CPC ..... A47C 21/044; F24F 7/007; A61F 7/00; A41D 13/005
USPC ..... 454/338; 607/104, 96
See application file for complete search history.

(56) References Cited

U.S. PATENT DOCUMENTS

| | | | | |
|---|---|---|---|---|
| 2,093,834 | A * | 9/1937 | Gaugler | 4/536 |
| 3,486,177 | A | 12/1969 | Marshack | 5/726 |
| 3,653,083 | A | 4/1972 | Lapidus | 5/348 |
| 4,660,388 | A * | 4/1987 | Greene, Jr. | 62/261 |
| 4,818,122 | A | 4/1989 | Arbuthnot | 383/10 |
| 4,977,634 | A | 12/1990 | Koji | 5/434 |
| 5,160,517 | A | 11/1992 | Hicks et al. | 55/385.1 |
| 5,300,100 | A * | 4/1994 | Hickle et al. | 607/107 |
| 5,926,884 | A | 7/1999 | Biggie et al. | 5/714 |
| 5,968,084 | A * | 10/1999 | Augustine et al. | 607/107 |
| 6,065,166 | A | 5/2000 | Sharrock et al. | 5/630 |
| 6,230,350 | B1 | 5/2001 | Goldstein | 5/638 |
| 6,421,859 | B1 | 7/2002 | Hicks et al. | 5/722 |
| 6,671,911 | B1 | 1/2004 | Hill et al. | 5/713 |
| 7,063,087 | B2 | 6/2006 | Cerbini et al. | 128/206.17 |
| 7,914,611 | B2 * | 3/2011 | Vrzalik et al. | 96/11 |
| 8,372,182 | B2 * | 2/2013 | Vrzalik et al. | 96/11 |

(Continued)

FOREIGN PATENT DOCUMENTS

| | | | |
|---|---|---|---|
| CN | 2156834 | Y | 2/1994 |
| CN | 101442924 | A | 5/2009 |

(Continued)

OTHER PUBLICATIONS

International Search Report and Written Opinion issued in International Application No. PCT/IB2013/000443, dated Aug. 9, 2013.

(Continued)

*Primary Examiner* — Steven B McAllister
*Assistant Examiner* — Ko-Wei Lin
(74) *Attorney, Agent, or Firm* — The Webb Law Firm

(57) ABSTRACT

In various embodiments, a support surface cooling device configured to reduce the skin temperature of a patient.

31 Claims, 4 Drawing Sheets

(56) References Cited

U.S. PATENT DOCUMENTS

| | | | | |
|---|---|---|---|---|
| 2004/0003471 | A1 | 1/2004 | VanSteenburg | 5/86.1 |
| 2004/0056013 | A1 | 3/2004 | Holmgren et al. | 219/217 |
| 2004/0112381 | A1 | 6/2004 | Ujhazy | 128/205.29 |
| 2004/0214495 | A1 | 10/2004 | Foss et al. | 442/181 |
| 2006/0010607 | A1 | 1/2006 | Schneider | 5/713 |
| 2007/0261548 | A1* | 11/2007 | Vrzalik et al. | 95/52 |
| 2011/0308020 | A1* | 12/2011 | Vrzalik et al. | 5/724 |

FOREIGN PATENT DOCUMENTS

| | | | |
|---|---|---|---|
| CN | 101969911 | A | 2/2011 |
| EP | 0 360 931 | | 4/1990 |
| FR | 2 893 826 | | 6/2007 |
| JP | 2001258688 | A | 9/2001 |
| JP | 2005-111048 | | 4/2005 |
| JP | 3124141 | U | 8/2006 |
| WO | WO 97/18738 | | 5/1997 |
| WO | WO 2007/134246 | | 11/2007 |
| WO | WO 2008/104004 | | 8/2008 |

OTHER PUBLICATIONS

May 5, 2016 SIPO Search Report Reference List issued in Chinese Application No. 104066411(filed Sep. 24, 2014) (2 pages with English translation).

* cited by examiner

SYSTEM FOR SUPPORT AND THERMAL CONTROL

CROSS-REFERENCE TO RELATED APPLICATIONS

This application claims priority to U.S. Provisional Patent Application No. 61/588,784, filed Jan. 20, 2012, which is incorporated by reference in its entirety.

FIELD OF THE INVENTION

The present disclosure relates generally to support surfaces for independent use and for use in association with beds and other support platforms, and more particularly but not by way of limitation to support surfaces that aid in the prevention, reduction, and/or treatment of decubitus ulcers and the transfer of moisture and/or heat from the body.

BACKGROUND

Patients and other persons restricted to bed for extended periods incur the risk of forming decubitus ulcers. Decubitus ulcers (commonly known as bed sores, pressure sores, pressure ulcers, etc.) can be formed when blood supplying the capillaries below the skin tissue is interrupted due to external pressure against the skin. This pressure can be greater than the internal blood pressure within a capillary and thus, occlude the capillary and prevent oxygen and nutrients from reaching the area of the skin in which the pressure is exerted. Moreover, moisture and heat on and around the person can exacerbate ulcers by causing skin maceration, among other associated problems.

SUMMARY

Exemplary embodiments of the present disclosure are directed to apparatus, systems and methods to reduce a patient's skin temperature and to aid in the prevention of decubitus ulcer formation and/or promote the healing of such ulcer formation.

In various embodiments, a support system cooling device (SSCD) comprises multiple layers configured to allow air flow through the layers and towards an air mover. Exemplary embodiments incorporate an air mover configured to provide air flow from approximately 1.0 cubic feet per minute (CFM) to approximately 50 CFM. Such air flow can provide high vapor transfer rates, including for example, those in excess of 500 gm/m2/hr. Additionally, with the higher air flow rates proximal to the patient, the skin temperature of the patient has calculated to be reduced to approximately 88 degrees Fahrenheit.

In certain embodiments, the SSCD comprises a support portion underneath a patient, while in other embodiments, the SSCD also comprises a cover portion configured to cover a patient. The support (and optionally, cover) portion are coupled to the air mover via a plurality of conduits that allow for air flow sufficient to provide moisture removal from a patient and conductive cooling to the skin of a patient.

Certain embodiments comprise a support surface cooling device comprising: an air mover; a first conduit; a first layer comprising a vapor permeable material; a second layer comprising a spacer material; and a third layer. In particular embodiments, the second layer is between the first layer and the third layer; the first conduit is in fluid communication with the second layer and the air mover; and the air mover is configured to create air flow through the spacer material toward the air mover. In certain embodiments, the first conduit is embedded within the second layer.

Certain embodiments comprise a support surface cooling device comprising: an air mover; a first layer comprising a vapor permeable material; a second layer comprising a spacer material; and a third layer, wherein: the second layer is between the first layer and the third layer; the air mover is configured to create air flow through the spacer material toward the air mover; and the air mover is configured to provide air flow between approximately 5 standard cubic feet per minute and approximately 50 standard cubic feet per minute.

In specific embodiments, the air mover is configured to provide air flow between approximately 5 standard cubic feet per minute and approximately 50 standard cubic feet per minute. In certain embodiments, the air flow is between approximately 10 standard cubic feet per minute and 50 standard cubic feet per minute, while in particular embodiments, the air flow is between approximately 20 standard cubic feet per minute and 50 standard cubic feet per minute.

In certain embodiments, the air mover is configured to create air flow sufficient to provide conductive cooling to the skin of a patient adjacent to the first layer. In particular embodiments, the spacer material comprises one of the following: open cell foam; natural or synthetic polymer particles, filaments, or strands; cotton fibers; polyester fibers; flexible metals and metal alloys; shape memory metals and metal alloys, and shape memory plastics. Specific embodiments may also comprise an antimicrobial device proximal to the air mover. In particular embodiments, the air mover is a centrifugal fan. Certain embodiments may comprise an antimicrobial device proximal to the air mover.

In particular embodiments, the support surface cooling device is configured to permit an air flow of 30 standard cubic feet per minute through the spacer material while supporting a person laying on the spacer material. In certain embodiments, the first layer, second layer and third layer are components of a support portion configured to be placed between a patient and a support mattress. Specific embodiments, may comprise a cover portion configured to cover a patient supported by the support mattress. Particular embodiments, may also comprise a second conduit in fluid communication with an air space between the support portion and the cover portion. In specific embodiments, the support portion and the cover portion are coupled together via a coupling mechanism. In particular embodiments, the coupling mechanism is selected from the group consisting of zippers, buttons, snaps, or stitching. Specific embodiments comprise a plurality of conduits in fluid communication with the second layer and the air mover.

Particular embodiments also include a method of reducing the skin temperature of a patient, where the method comprises providing a support surface cooling device comprises an air mover; a conduit; a vapor permeable layer; and a spacer material adjacent the vapor permeable layer, wherein the conduit is in fluid communication with the air mover and the spacer material. Certain embodiments also comprise placing the vapor permeable layer adjacent a skin surface of the patient; operating the air mover to create an air flow through the spacer material and the conduit toward the air mover; and reducing the skin temperature of the patient. In particular embodiments, the air flow is between approximately 5 standard cubic feet per minute and 30 standard cubic feet per minute, or between approximately 10 standard cubic feet per minute and 30 standard cubic feet per minute, or between approximately 20 standard cubic feet per minute and 30 standard cubic feet per minute.

In certain embodiments, the vapor permeable layer and the spacer material are placed between the patient and a support mattress. In particular embodiments, the vapor permeable layer and the spacer material are placed on top of the patient. In specific embodiments, the vapor permeable layer and the spacer material are placed both on top of the patient and between the patient and a support mattress. In certain embodiments, the spacer material comprises one of the following: open cell foam; natural or synthetic polymer particles, filaments, or strands; cotton fibers; polyester fibers; flexible metals and metal alloys; shape memory metals and metal alloys, and shape memory plastic. In particular embodiments, the skin temperature of the patient is reduced via conductive cooling.

BRIEF DESCRIPTION OF THE DRAWINGS

While exemplary embodiments of the present invention have been shown and described in detail below, it will be clear to the person skilled in the art that changes and modifications may be made without departing from the scope of the invention. As such, that which is set forth in the following description and accompanying drawings is offered by way of illustration only and not as a limitation. The actual scope of the invention is intended to be defined by the following claims, along with the full range of equivalents to which such claims are entitled.

In addition, one of ordinary skill in the art will appreciate upon reading and understanding this disclosure that other variations for the invention described herein can be included within the scope of the present invention. For example, portions of the support system shown and described may be incorporated with existing mattresses or support materials. Other embodiments may utilize the support system in seating applications, including but not limited to, wheelchairs, chairs, recliners, benches, etc.

In the following Detailed Description of Disclosed Embodiments, various features are grouped together in several embodiments for the purpose of streamlining the disclosure. This method of disclosure is not to be interpreted as reflecting an intention that exemplary embodiments of the invention require more features than are expressly recited in each claim. Rather, as the following claims reflect, inventive subject matter lies in less than all features of a single disclosed embodiment. Thus, the following claims are hereby incorporated into the Detailed Description of Disclosed Embodiments, with each claim standing on its own as a separate embodiment.

Figure 1:
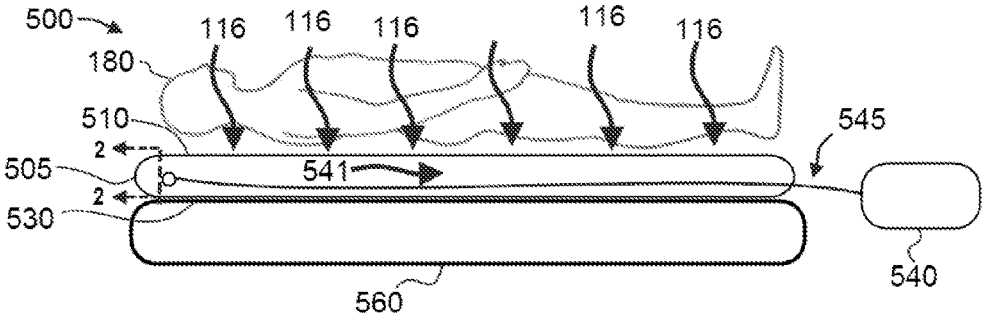

FIG. 1 illustrates a side view of a first exemplary embodiment of a support surface cooling device and a support mattress supporting a person.

Figure 2:
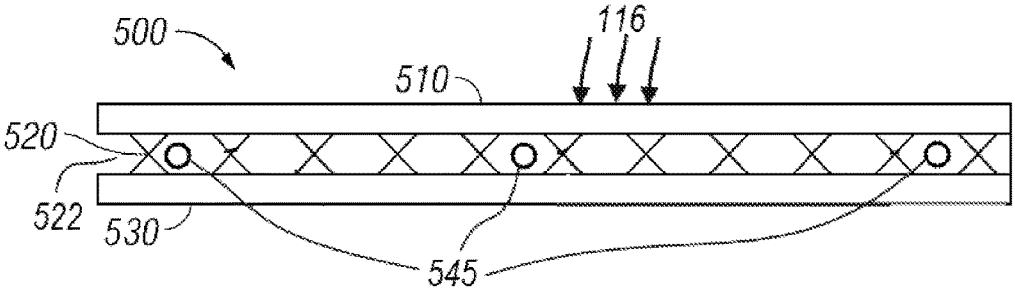

FIG. 2 illustrates a cross-sectional end view of the device of FIG. 1 take along line 2-2 of FIG. 1.

Figure 3:
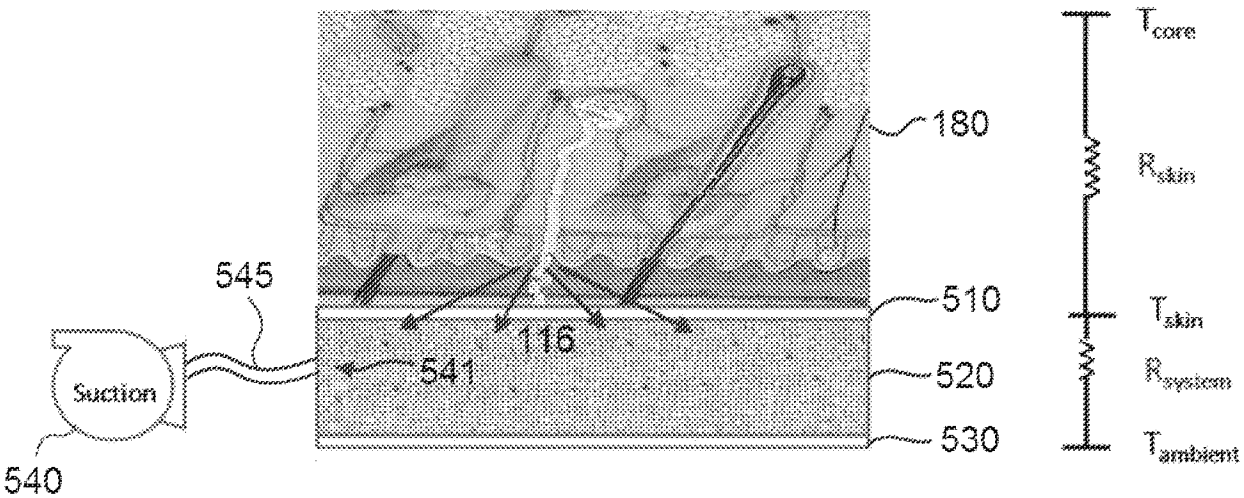

FIG. 3 illustrates a detailed cross-sectional view of a support surface cooling device adjacent a skin surface.

Figure 4:
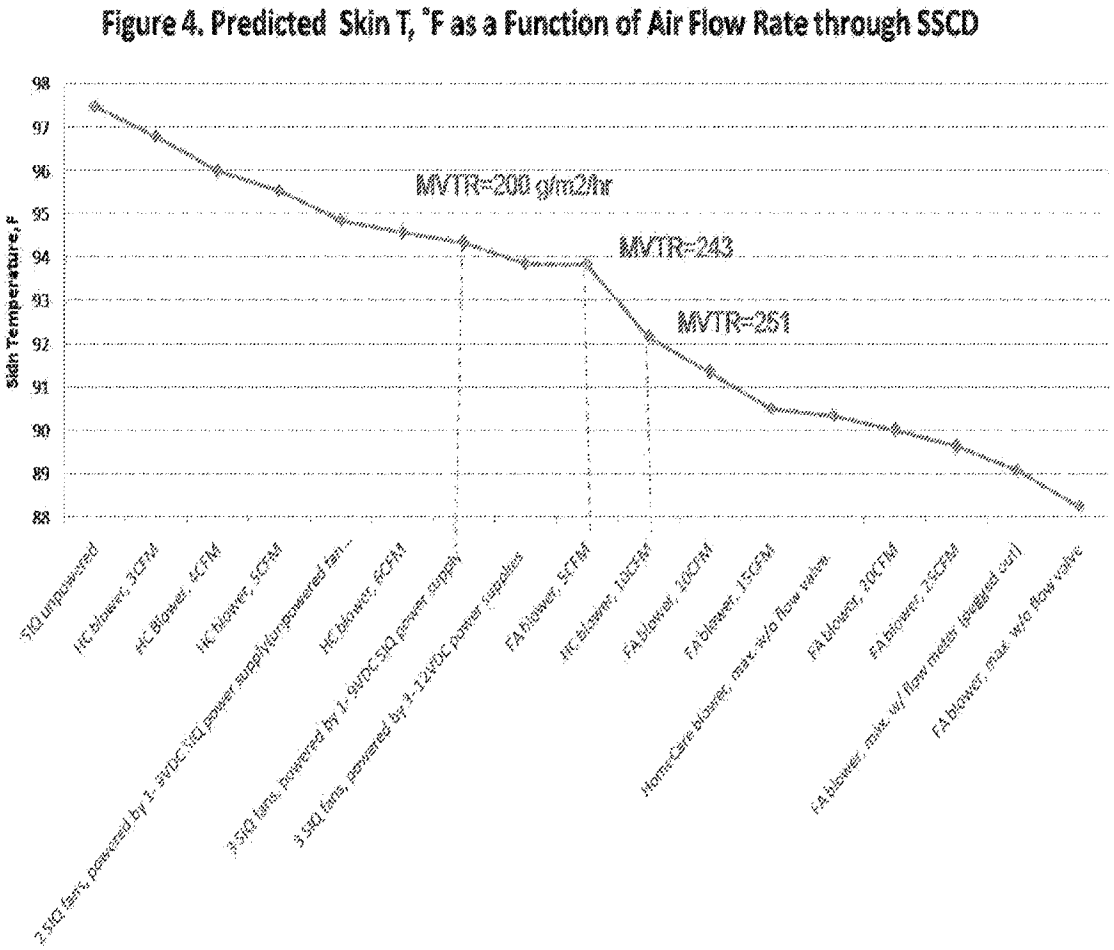

FIG. 4 illustrates a graph of predicted skin temperature versus air flow.

Figure 5:
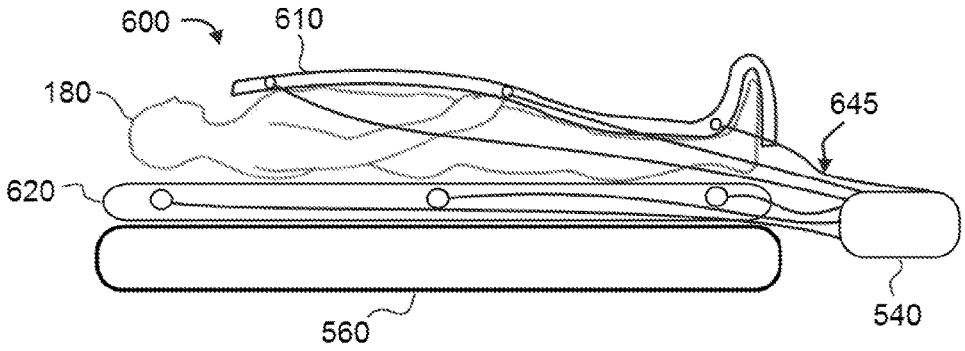

FIG. 5 illustrates a side view of a second exemplary embodiment of a support surface cooling device and a support mattress supporting a person.

Figure 6:
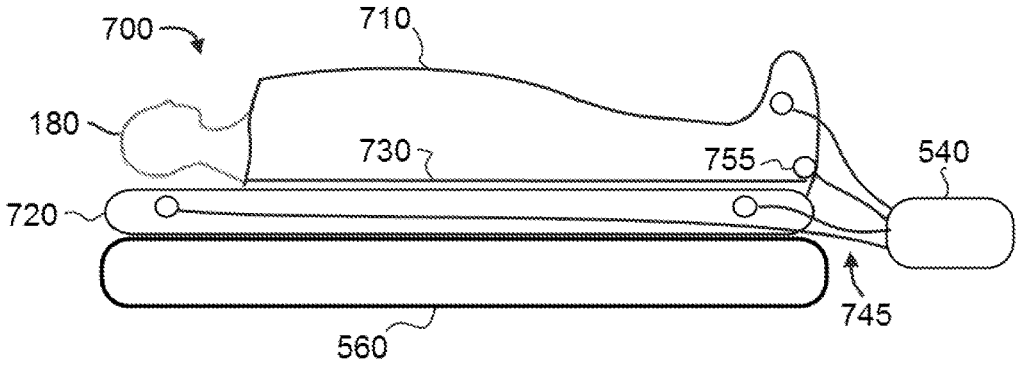

FIG. 6 illustrates a side view of a third exemplary embodiment of a support surface cooling device and a support mattress supporting a person.

DETAILED DESCRIPTION OF DISCLOSED EMBODIMENTS

Exemplary embodiments of the present disclosure are directed to apparatus, systems and methods to aid in the prevention of decubitus ulcer formation and/or promote the healing of such ulcer formation. For example, in various embodiments, reducing skin temperature, preventing ulcer formation and/or healing decubitus ulcers can be accomplished through the use of a support surface cooling device. Exemplary embodiments of the device can be utilized to aid in the removal of moisture, vapor, and heat adjacent and proximal the patient surface interface and in the environment surrounding the patient by providing a surface that absorbs and/or disperses the moisture, vapor, and heat from the patient. In addition, the exemplary embodiments of the device can be utilized in combination with a number of support surfaces or platforms to provide a reduced interface pressure between the patient and the device on which the patient is positioned. This reduced interface pressure can help to prevent the formation of decubitus ulcers.

In various exemplary embodiments, the support surface cooling device may include a number of layers. Each layer may be formed of a number of different materials that exhibit various properties. These properties may include the level of friction or shear of a surface, the permeability of a vapor, a gas, a liquid, and/or a solid, and various phases of the vapor, the gas, the liquid, and the solid, and other properties.

For example, in exemplary embodiments, the support surface cooling device may include materials that provide for a low air loss feature, where one or more layers exhibit various air, vapor, and liquid permeable properties and/or where one or more layers are bonded or sealed together. As used herein, a low air loss feature of a support surface cooling device includes, but is not limited to: a multi-layer device that allows air and vapor to pass through the first layer in the presence of a partial pressure difference in vapor between the internal and external environments of the multi-layer device; a multi-layer device that allows air and vapor to pass through the first layer in the absence of a partial pressure difference in vapor between the internal and external environments of the multi-layer device; and a multi-layer device that allows air and vapor to move into and/or out of the multi-layer device through the apertures in one or more layers.

In other exemplary embodiments, the multi-layer device can include materials that provide for substantially no air flow, where one or more layers include air impermeable properties and/or where layers are bonded or sealed together to a layer comprising a spacer material. In such exemplary embodiments, this configuration may control the direction of movement of air from outside to inside (e.g., under influence by a source of negative pressure at the air inlet for the multi-layer device). Certain exemplary embodiments comprise a multi-layer device including, but is not limited to, the following: a device that prevents or substantially prevents air from passing through the first layer, but allows for the passing of vapor through the first layer; a device that prevents or substantially prevents air from moving through the first layer in the presence of a partial vapor pressure difference between the internal and external environments of the multi-layer device, but allows for the passing of vapor through the first layer; and a device that prevents or substantially prevents air from moving out of the multi-layer device via the material forming a particular layer of the device, but allows air to move through the apertures in one or more layers.

In various exemplary embodiments, systems are provided that can include a number of components that both aid in prevention of decubitus ulcer formation and to remove moisture and/or heat from the patient. For example, systems can include a support surface cooling device (SSCD) that can be used in conjunction with a variety of support surfaces, such as an inflatable mattress, a foam mattress, a gel mattress, a water mattress, or fluid mattress of a hospital bed. In such exemplary embodiments, features of the SSCD can help to remove moisture and heat from the patient and to lower interface pressure between a patient and the surface of the SSCD, while features of the inflatable or foam mattress can aid in the prevention and/or healing of decubitus ulcers by further lowering interface pressures at areas of the skin in which external pressures are typically high, as for example, at bony prominences such as the heel and the hip area of the patient. In other exemplary embodiments, systems can include the SSCD used in conjunction with a chair or other support platform.

Referring now to FIG. 1, an exemplary embodiment of a support surface cooling device (SSCD) 500 is shown placed on a support mattress 560 and beneath a patient 180. In this embodiment, SSCD 500 comprises support portion 505 with a water vapor-permeable first layer 510, a middle layer 520 comprising a spacer material, and a third layer 530. In the embodiment shown, first layer 510 is proximal to patient 180, while third layer 530 is distal to patient 180.

In this embodiment, support portion 505 is also coupled to air mover 540 via a plurality of conduits 545 that can allow for substantial air flow 541 from middle layer 520 to air mover 540. In certain embodiments, conduits 545 may be embedded in middle layer 520. In other exemplary embodiments, air mover 541 can be configured to provide air flow 541 to middle layer 520 without the use of conduits. For example, air mover 541 may be directly coupled to support portion 505 such that air flow 541 is directed to middle layer 520. In certain embodiments, air mover 540 is capable of providing between approximately 5 and 50 standard cubic feet per minute (SCFM) of air flow between support portion 505 and air mover 540. In particular embodiments, air mover 540 is capable of providing between approximately 10 SCFM and 50 SCFM or between approximately 20 SCFM and 50 SCFM of air flow between support portion 505 and air mover 540. As explained in further detail below, such air flow can provide for vapor transfer rates sufficient to reduce the skin temperature of the patient.

The general principles of operation for this exemplary embodiment are provided initially, followed by a more detailed description of individual components and principles of operation. In general, moisture vapor 116 is transferred from a patient 180, through first layer 510, to air contained in middle layer 520. In exemplary embodiments, air mover 540 pulls air through middle layer 520 (e.g., via conduits 545) so that moisture vapor 116 can be removed from the air contained in middle layer 520. In addition, air flow 541 reduces the temperature of the patient's skin. The use of negative air pressure to draw room temperature air into the coverlet causes moisture vapor from patient 180 to evaporate. This can cause a cooling of the air inside support portion 505 and provide an inductive cooling to patient 180. In addition air flow 541 in middle layer 520 can be a lower temperature than the skin temperature of patient 180, which can provide conductive cooling of patient 180.

In certain embodiments, first layer 510 is comprised of a material that is liquid and air impermeable and either vapor permeable or vapor impermeable. One example of such vapor permeable material is sold under the trade name GoreTex™. GoreTex™ is vapor permeable and liquid impermeable, but may be air permeable or air impermeable. Examples of such vapor impermeable materials include sheet vinyl or sheet urethane. In the embodiment shown, middle layer 520 comprises a spacer material that separates first layer 510 and third layer 530. As used in this disclosure, the term "spacer material" (and related terms) should be construed broadly to include any material that includes a volume of air within the material and allows air to move through the material. In exemplary embodiments, spacer materials allow air to flow through the material when a person is laying on the material while the material is supported by a mattress. Examples of such spacer materials include open cell foam, polymer particles, and a material sold by Tytex under the trade name AirX™.

In the exemplary embodiment shown, third layer 530 comprises a material that is vapor impermeable, air impermeable, and liquid impermeable. Examples of such material include sheet vinyl plastic or sheet polyurethane material. First layer 510 and third layer 530 may be comprised of the same material in certain embodiments.

Support mattress 560 can be any configuration known in the art for supporting person 180. For example, in certain exemplary embodiments, support mattress 560 may be an alternating-pressure-pad-type mattress or other type of mattress utilizing air to inflate or pressurize a cell or chamber within the mattress. In other exemplary embodiments, support mattress 560 does not utilize air to support person 180 and may comprise, for example, foam, gel, water, or other suitable support materials.

Referring still to FIG. 1, support mattress 560 and support portion 505 provide support for person 180 and aid in the removal of moisture, vapor and heat adjacent and proximal the interface between person 180 and support portion 505. In the exemplary embodiment of FIG. 1, SSCD 500 comprises a plurality of conduits 545 that are in fluid communication with both the air mover 540 and the spacer material of middle layer 520. During operation, air mover 540 shown in FIG. 1 operates to reduce pressure within support portion 505 and create a negative pressure or suction air flow 541 that is directed through middle layer 520 and toward air mover 540.

Referring now to FIG. 2, a cross-section end view of support portion 505 illustrates the multiple layers. During operation of SSCD 500, moisture vapor 116 is transferred from person 180 (and the air adjacent person 180) through first layer 510 to air pockets within the spacer material of middle layer 520. Moisture vapor 116 will continue to transfer to air pockets within spacer material 522 while the air pockets are at a lower relative humidity than the air adjacent person 180. As the relative humidity of the air pockets increases and approaches the relative humidity of the air adjacent person 180, the transfer rate of moisture vapor 116 will decrease. It is therefore desirable to maintain a lower relative humidity of the air pockets within middle layer 520 than the relative humidity of the air adjacent person 180. As moisture vapor 116 is transferred to air pockets within middle layer 520, it is desirable to remove moisture vapor from the air pockets and lower the relative humidity of the air within middle layer 520. The relative humidity of air in middle layer 520 can be reduced to that of the surrounding environment. By removing moisture vapor 116 from the air within middle layer 520, the transfer rate of moisture vapor 116 from person 180 can be maintained at a more uniform level.

In the exemplary embodiment shown in FIGS. 1 and 2, air flow 541 flows through the air pockets within middle layer 520 and assists in removing moisture vapor 116 from the air pockets. This lowers the relative humidity of the air pockets and allows the transfer rate of moisture vapor 116 to be maintained over time. As shown in FIGS. 1 and 2, air flow 541 can be drawn or pulled through middle layer 520 toward air mover 540. As explained in more detail below, the skin temperature of patient 180 can be reduced during operation of SSCD 500.

Referring now to FIG. 3, a detailed sectional view of support portion 505 is shown adjacent the skin of patient 180. Without desiring to be bound by theory, the skin temperature of patient 180 can be calculated by the following formula (assuming the skin is dry without sweating):

$$T_{skin} = \frac{(T_{core} - T_{ambient}) \times R_{system}}{(R_{system} + R_{skin})} + T_{ambient}$$

where:

$T_{skin}$=the patient's external skin temperature $T_{core}$=the patient's skin core temperature (37° C./98.6° F.)

$T_{ambient}$=the ambient temperature (25° C./77° F.)

$R_{system}$–SSCD resistance to heat transfer $R_{skin}$=skin resistance to heat transfer (0.05 $m^{2\circ}$ K/W)

The use of negative pressure to create air flow allows room temperature air to flow into SSCD 500, creating a greater temperature differential between the surrounding air and the skin of patient 180. In addition, negative pressure draws first layer 510 and third layer 530 against the spacer material of middle layer 520. This can direct air flow 541 through middle layer 520, creating a higher air velocity of air flow 541 and expedite the evaporation of moisture vapor 116. If positive air pressure (e.g. air flow 541 directed away from air mover 540) were utilized instead, it could separate the first layer 510 or third layer 530 from middle layer 520. This billowing of first layer 510 or third layer 530 can allow airflow 541 to bypass the spacer middle layer 520, and the velocity of airflow 541 within middle layer 520 to be reduced. The reduced airflow velocity also reduces the ability of SSCD to remove moisture vapor from patient 180 and lower the skin temperature of patient 180.

Referring now FIG. 4, a graph illustrates the predicted skin temperature of a patient with use of SSCD 500. As shown in FIG. 4, the predicted skin temperature is reduced from approximately 97.5° F. with no airflow to approximately 88° F. with maximum airflow of approximately 30 cubic feet per minute (CFM). Various sizes of air movers were used in testing. In this test example, the air mover was an Ametek® model 119103-00 Type H, 8 amp, 50/60 Hz, 120 V, with maximum air flow of over 100 CFM.

As one of ordinary skill in the art will appreciate, vapor and air can carry organisms such as bacteria, viruses, and other potentially harmful pathogens. As such, and as will be described in more detail herein, in some embodiments of the present disclosure, one or more antimicrobial devices, agents, etc., can be provided to prevent, destroy, mitigate, repel, trap, and/or contain potentially harmful pathogenic organisms including microbial organisms such as bacteria, viruses, mold, mildew, dust mites, fungi, microbial spores, bioslimes, protozoa, protozoan cysts, and the like, and thus, remove them from air and from vapor that is dispersed and removed from the patient and from the environment surrounding the patient. In addition, in various embodiments, the SSCD 500 can include various layers having antimicrobial activity. In some embodiments, for example, first, middle and third layers, 510, 520 and 530 can include particles, fibers, threads, etc., formed of silver and/or other antimicrobial agents.

In various exemplary embodiments, middle layer 520 can be formed of various materials, and can have a number of configurations and shapes, as described herein. In some embodiments, the material is flexible. In such exemplary embodiments, the flexible material can include properties that resist compression, such that when the flexible material is compressed, for example, by the weight of a patient lying on support portion 505, the flexible material has a tendency to return toward its original shape, and thereby impart a supportive function to support portion 505. The flexible material can also include a property that allows for lateral movement of air through the flexible material even under compressive loads.

Examples of materials that can be used to form middle layer 520 can include, but are not limited to, natural and synthetic polymers in the form of particles, filaments, strands, foam (e.g., open cell foam), among others, and natural and synthetic materials such as cotton fibers, polyester fibers, and the like. Other materials can include flexible metals and metal alloys, shape memory metals and metal alloys, and shape memory plastics. These materials can include elastic, super elastic, linear elastic, and/or shape memory properties that allow the flexible material to flex and bend and to form varying shapes under varying conditions (e.g., compression, strain, temperature, etc.).

In various exemplary embodiments, SSCD 500 can be a one-time use device or a multi-use device. As used herein, a one-time use device is a device for single-patient use applications that is formed of a vapor, air, and liquid permeable material that is disposable and/or inexpensive and/or manufactured and/or assembled in a low-cost manner and is intended to be used for a single patient over a brief period of time, such as an hour(s), a day, or multiple days or weeks. As used herein, a multi-use device is a device for multi-patient use that is generally formed of a vapor permeable, liquid impermeable and air permeable or air impermeable material that is re-usable, washable, can be disinfected using a variety of techniques (e.g., autoclaved, bleach, etc.) and generally of a higher quality and superior in workmanship than the one-time use device and is intended to be used by one or more patients over a period of time such as multiple days, weeks, months, and/or years. In various exemplary embodiments, manufacturing and/or assembly of a multi-use device can involve methods that are more complex and more expensive than one-time use device. Examples of materials used to form one-time use devices can include, but are not limited to, non-woven papers. Examples of materials used to form re-usable devices can include, but are not limited to, Gore-Tex®, and urethane laminated to fabric.

Referring now to FIG. 5, in certain embodiments an SSCD 600 may comprise a cover portion 610 configured to cover patient 180 in addition to a support portion 620 between patient 180 and support mattress 560. In certain exemplary embodiments, support portion 620 is configured equivalent to SSCD 500 and cover portion 610 is configured equivalent to an inverted SSCD 500. For example, cover portion 610 may comprise three layers, including a first layer proximal to patient 180 that is equivalent to first layer 510, a middle layer equivalent to middle layer 520, and a third layer proximal to the environment that is equivalent to third layer 530.

SSCD 600 also comprises a plurality of conduits 645 in fluid communication with air mover 540 and cover portion 610 and support portion 620. During operation, SSCD 600 can also serve to remove moisture vapor and decrease the skin temperature of patient 180 in a manner generally equivalent to that of SSCD 500 described previously. SSCD 600, however, may provide for more effective moisture vapor removal and skin temperature reduction by covering more skin surface area of patient 180 than embodiments that only include a support portion underneath patient 180.

Referring now to FIG. 6, in certain embodiments an SSCD 700 may comprise a cover portion 710 that is coupled to a support portion 720. In particular embodiments, cover portion 710 may be coupled to support portion 720 via a coupling mechanism 730. In specific embodiments, coupling mechanism 730 may comprise one or more zippers, buttons, snaps or other suitable devices. In other embodiments, cover portion 710 and support portion may be sewn or stitched together to form a unitary component similar to a sleeping bag. Similar to previously-described embodiments, this embodiment comprises a plurality of conduits 645 in fluid communication with air mover 540 and cover portion 710 and support portion 720. In addition, this embodiment comprises a conduit 755 directed to the air space between cover portion 710 and support portion 720. During operation, conduit 755 can reduce the pressure in the air space between cover portion 710 and support portion 720 and draw cover portion toward patient 180 and support portion 720. During operation, SSCD 700 can also serve to remove moisture vapor and decrease the skin temperature of patient 180 in a manner generally equivalent to that of SSCD 600 described previously.

The invention claimed is:

1. A support surface cooling device comprising:
an air mover;
a cover portion configured to cover a patient;
a support portion placed between a patient and a mattress, wherein the support portion comprises:
a first layer comprising a vapor permeable material;
a second layer comprising a spacer material; and
a third layer, wherein:
the second layer is between the first layer and the third layer;
the air mover is in direct fluid communication with a first conduit and configured to suction air flow through the spacer material toward the air mover to cool a patient supported on the support portion and covered by the cover portion; and
a second conduit in direct fluid communication with the air mover and an air space between an upper surface of the support portion and a lower surface of the cover portion so as to draw the cover portion towards the patient and the support portion.

2. The support surface cooling device of claim 1 wherein the air mover is configured to provide air flow between approximately 5 standard cubic feet per minute and approximately 50 standard cubic feet per minute.

3. The support surface cooling device of claim 1 wherein the air flow is between approximately 10 standard cubic feet per minute and 50 standard cubic feet per minute.

4. The support surface cooling device of claim 1 wherein the air flow is between approximately 20 standard cubic feet per minute and 50 standard cubic feet per minute.

5. The support surface cooling device of claim 1 wherein the air mover is configured to create air flow sufficient to provide conductive cooling to the skin of a patient adjacent to the first layer.

6. The support surface cooling device of claim 1 wherein the spacer material comprises one of the following: open cell foam; natural or synthetic polymer particles, filaments, or strands; cotton fibers: polyester fibers: flexible metals and metal alloys; shape memory metals and metal alloys, and shape memory plastics.

7. The support surface cooling device of claim 1 further comprising an antimicrobial device proximal to the air mover.

8. The support surface cooling device of claim 1 wherein the air mover is a centrifugal fan.

9. The support surface cooling device of claim 1 wherein the support surface cooling device is configured to permit an air flow of 30 standard cubic feet per minute through the spacer material while supporting a person laying on the spacer material.

10. The support surface cooling device of claim 1, further comprising a second conduit in fluid communication with and embedded in the second layer.

11. The support surface cooling device of claim 1 wherein the support portion and the cover portion are coupled together via a coupling mechanism.

12. The support surface cooling device of claim 11 wherein the coupling mechanism is selected from the group consisting of zippers, buttons, snaps, or stitching.

13. The support surface cooling device of claim 1, further comprising a plurality of second conduits in fluid communication with the second layer and the air mover.

14. A support surface cooling device comprising:
an air mover;
a support portion placed between a patient and a mattress; and
a cover portion configured to cover a patient supported by the support portion,
wherein each of the support portion and the cover portion comprises:
a first layer comprising a vapor permeable material;
a second layer comprising a spacer material; and
a third layer, wherein the second layer is between the first layer and the third layer; and
when the patient is supported on the support portion and covered by the cover portion, the air mover is directly connected to and in fluid communication with the cover portion and the support portion to create air flow through the cover portion and through the support portion toward the air mover to conductively cool a patient at a region adjacent to the first layer of the support portion and at a region adjacent to the first layer of the cover portion.

15. The support surface cooling device of claim 14 wherein the air flow is between approximately 5 standard cubic feet per minute and 50 standard cubic feet per minute.

16. The support surface cooling device of claim 14 wherein the air flow is between approximately 20 standard cubic feet per minute and 50 standard cubic feet per minute.

17. The support surface cooling device of claim 14 further comprising one or more second conduits in fluid communication with the second layer and the air mover.

18. The support surface cooling device of claim 14 wherein the spacer material comprises one of the following: open cell foam; natural or synthetic polymer particles, filaments, or strands; cotton fibers; polyester fibers; flexible metals and metal alloys; shape memory metals and metal alloys, and shape memory plastics.

19. The support surface cooling device of claim 14 further comprising an antimicrobial device proximal to the air mover.

20. The support surface cooling device of claim 14 wherein the air mover is a centrifugal fan.

21. The support surface cooling device of claim 14 wherein the support surface cooling device is configured to permit an air flow of 30 standard cubic feet per minute through the spacer material while supporting a person laying on the spacer material.

22. The support surface cooling device of claim 14 further comprising a first conduit in fluid communication with an air space between the support portion and the cover portion.

23. The support surface cooling device of claim 14 wherein the support portion and the cover portion are coupled together via a coupling mechanism.

24. The support surface cooling device of claim 23 wherein the coupling mechanism is selected from the group consisting of zippers, buttons, snaps, or stitching.

25. A method for using a support surface cooling device, wherein the device comprises:

an air mover;

a support portion placed between a patient and a mattress, wherein the support portion is in direct fluid communication with the air mover and wherein the support portion comprises:

a first layer comprising a vapor permeable material;

a second layer comprising a spacer material; and a third layer, wherein the second layer is between the first layer and the third layer; and a cover portion configured to cover a patient supported by the support portion, wherein the cover portion is in direct fluid communication with the air mover, wherein the method comprises the step of:

when the patient is supported on the support portion and covered by the cover portion, conductively cooling a portion of the patient adjacent to the first layer of the support portion and a portion of the patient adjacent to the cover portion by moving air through a spacer material of the second layer towards the air mover and by moving air through a portion of the cover towards the air mover.

26. The method of claim 25, wherein the method comprises reducing the pressure of an air space between the cover portion and the support portion and drawing the cover portion towards the patient and support portion using a conduit in fluid communication with an air space between the cover portion and the support portion.

27. The method of claim 25, wherein one or more support portion conduits are in fluid communication between the air mover and the second layer, and wherein one or more cover portion conduits are in fluid communication between the air mover and the cover portion to move air towards the air mover.

28. The method of claim 25, wherein the method further comprises detachably coupling the support portion to the cover portion.

29. The method of claim 25, wherein air is moved through the spacer material of the second layer towards the air mover at a rate of about 5 standard cubic feet per minute to about 50 standard cubic feet per minute.

30. The method of claim 26, wherein the support surface cooling device is that disclosed in claim 1.

31. The method of claim 25, wherein the support surface cooling device is that disclosed in claim 14.

* * * * *